US005197412A

United States Patent [19]

Wade

[11] Patent Number: 5,197,412

[45] Date of Patent: Mar. 30, 1993

[54] CALF CHUTE APPARATUS

[76] Inventor: Freddie E. Wade, Rte. 4, Box 674, Warrensburg, Mo. 64093

[21] Appl. No.: 922,802

[22] Filed: Jul. 31, 1992

[51] Int. Cl.[5] ..... A61D 3/00

[52] U.S. Cl. ..... 119/99

[58] Field of Search ..... 119/98, 99, 147.1, 148, 119/96, 27

[56] References Cited

U.S. PATENT DOCUMENTS

| | | | |
|---|---|---|---|
| Re. 22,657 | 8/1945 | Babson et al. | 119/147.1 |
| 2,198,048 | 4/1940 | Babson et al. | 119/27 |
| 3,885,527 | 5/1975 | Maffet et al. | 119/98 |

*Primary Examiner*—Gene Mancene
*Assistant Examiner*—Thomas Price
*Attorney, Agent, or Firm*—Hovey, Williams, Timmons & Collins

[57] ABSTRACT

A calf chute apparatus for restraining newborn calves includes a frame formed of a first side panel, and a second side panel connected to the frame for pivotal movement. The frame and second side panel together define a neck restraint assembly for restraining the neck of a calf positioned in the apparatus when the second side panel is in a closed position relative to the frame. The restraint assembly includes a first neck restraint mounted on the frame and a second neck restraint mounted on the second side panel. The second neck restraint and second side panel are movable together relative to the frame so that when the second side panel is moved between the open and closed positions, the second neck restraint moves between a releasing and a restraining position relative to the first neck restraint.

5 Claims, 1 Drawing Sheet

CALF CHUTE APPARATUS

BACKGROUND OF THE INVENTION

1. Field of the Invention

The present invention relates generally to animal restraining enclosures and, more particularly, to a calf chute apparatus for holding and restraining a newborn calf to expedite handling and treatment of the calf.

2. Discussion of the Prior Art

It is known to provide a calf restraint enclosure for use with calves and cattle ranging in size from 400 lbs up, the enclosure including a frame defined by a pair of parallel side panels, a front panel fitted with a head gate assembly for pinching the neck of the calf to hold the calf within the enclosure, and a rear gate movable between an open and closed position for allowing the calf to be loaded into the gate. In these known constructions, the head gate assembly operates independently of the rear gate, and each assembly includes a separate operating mechanism which must be operated in order to load and restrain the animal.

OBJECTS AND SUMMARY OF THE INVENTION

Because conventional devices include separate operating mechanisms at each end thereof, they are typically complex, requiring substantial construction and assembly. Further, because the known devices are designed for use with cattle within a certain size range, they are not practical for use with newborn calves weighing less than about 200 lbs.

It would be advantageous, and it is an object of the present invention, to provide a calf chute apparatus of simple construction which may be used to restrain newborn calves weighing less than about 200 lbs so that animals of this size may be transported, banded, or tagged or may otherwise be treated or transported without a risk of being physically harmed due to improper restraint.

Numerous benefits are presently being realized as a result of working on calves as early as possible after birth. For example, banding newborn calves reduces the amount of stress experienced by the calves during development after banding, as compared with the amount of stress experienced by calves banded when older, and the smaller calves are easier to handle because of their light weight.

In addition, another advantage to working calves at an early age is that by tagging newborns it is easier to identify the calves thereafter during development. Further, if implants are used, it is best that these be implanted as early as possible in the development of the calf in order to maximize the growth potential offered by such treatments.

In accordance with one aspect of the present invention, a calf chute apparatus comprises a frame including a first side panel, and a second side panel connected for pivotal movement relative to the frame about a vertical axis between open and closed positions. The apparatus also includes a neck restraining means for restraining the neck of a calf positioned in the apparatus when the second side panel is in the closed position. The restraining means includes a first neck restraint mounted on the frame and a second neck restraint mounted on the second side panel. The second neck restraint and second side panel are movable together relative to the frame so that when the second side panel is moved between the open and closed positions, the second neck restraint moves between a releasing and a restraining position relative to the first neck restraint.

Thus, a calf chute apparatus is provided which is of simple construction, while being easy to operate and sized for accommodating newborns calves weighing less than about 200 lbs. Further, because the restraining means operates in conjunction with movement of the second side panel, it is possible for one person to hold the calf in the chute while closing the second side panel and the restraining means to secure the animal in place.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 2:
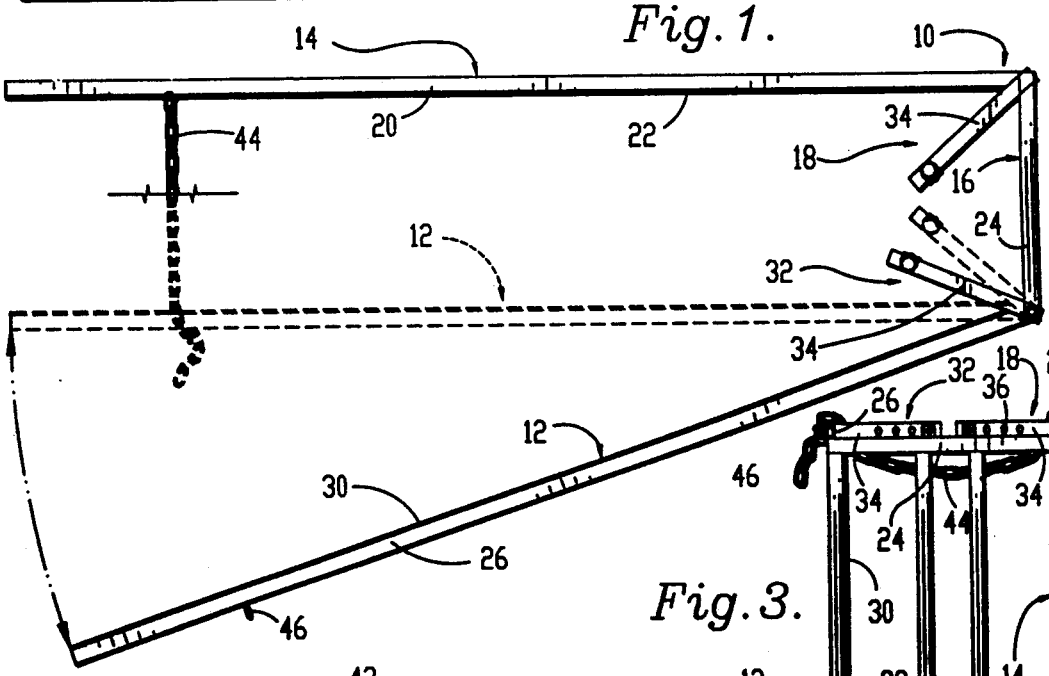
FIG. 2 is a top plan view of the apparatus, illustrating the range of movement of a second side panel relative to the frame of the apparatus.

A calf chute apparatus constructed in accordance with the preferred embodiment is illustrated in FIG. 2, and includes a frame 10 and a side panel 12 connected for pivotal movement relative to the frame about a vertical axis between an open position, shown in solid lines in the figure, and a closed position, as depicted in dashed lines in the figure.

The frame 10 includes a side panel 14 similar in construction to the side panel 12, a front wall 16 extending between the side panels 12, 14 at the forward end of the apparatus, and a first portion 18 of a neck restraint assembly. The side panel 14 includes a pair of vertically spaced, horizontally extending tubular frame members 20, preferably formed of metal or otherwise rigid material capable of restraining the animal to be retained in the enclosure. Additional frame members may be provided between the horizontally extending members, if desired, and the panel may be closed by providing a sheet 22 of metal or the like across the panel 14 or any portion thereof.

Figure 3:
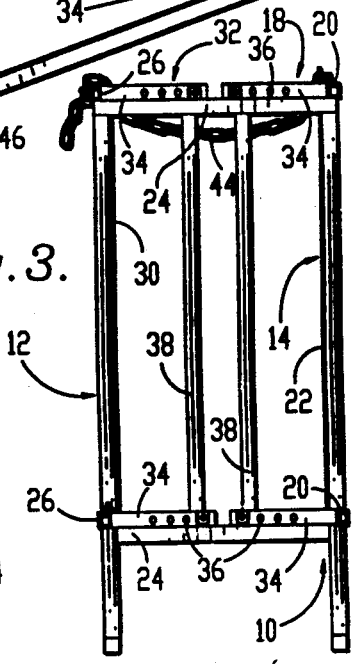
FIG. 3 is a front elevational view of the apparatus.

As shown in FIG. 3, two vertically spaced, horizontally extending tubular members 24 define the front wall 16 and are secured, e.g. by welding, to the forward ends of the tubular frame members 20. The members 24 of the front wall extend in a direction perpendicular to the tubular members 20, as shown in FIG. 2.

Figure 1:
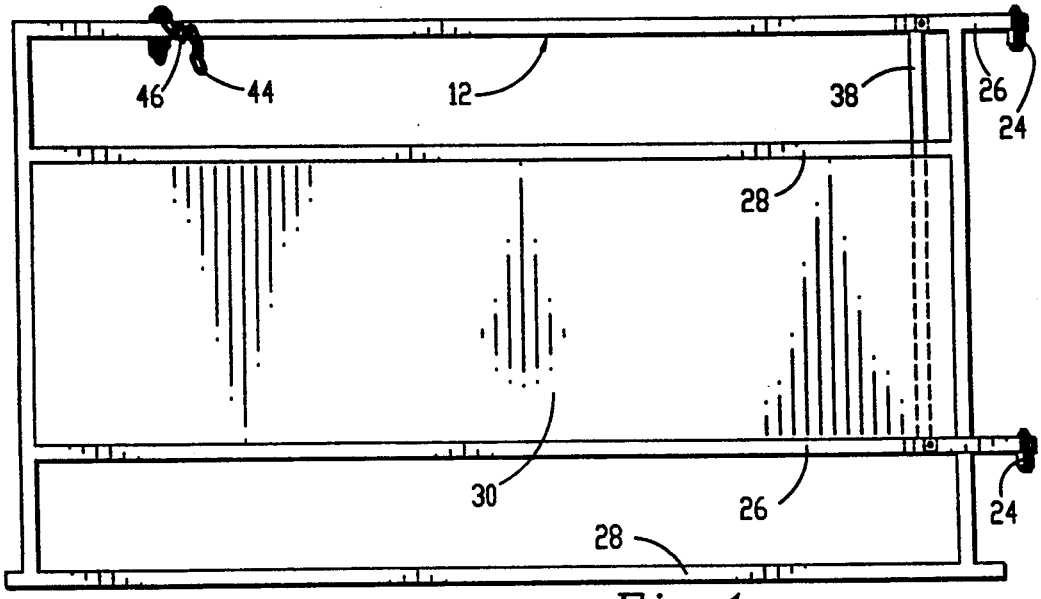
FIG. 1 is a side elevational view of a calf chute apparatus constructed in accordance with the preferred embodiment.

Turning to FIG. 1, the side panel 12 also includes a pair of vertically spaced, horizontally extending tubular members 26, preferably also formed of metal or otherwise rigid material capable of restraining the animal to be retained in the enclosure. Additional tubular members 28 may be provided between the horizontally extending members 26, if desired, and the panel 12 may be closed by providing a sheet 30 of metal or the like across the panel or any portion thereof.

Returning to FIG. 2, the forward ends of the tubular members 26 are secured to the members 24 of the front wall by bolts or the like which permit the panel 12 to be pivoted relative to the frame 10 along a path shown in FIG. 2. The side panel 12 includes a second portion 32 of the neck restraint assembly which, together with the first portion 18 defines a neck restraining means for restraining the neck of a calf positioned in the apparatus when the side panel 12 is in the closed position. The first portion 18 of the neck restraint assembly mounted on the frame 10 remains stationary relative to the frame during movement of the panel 12, while the second portion 32 mounted on the side panel 12 moves with the side panel relative to the frame.

Because the second portion 32 of the neck restraint and the side panel 12 are movable together relative to the frame 10, when the side panel 12 is moved between the open and closed positions, the second portion 32 of the neck restraint assembly moves between a releasing position spaced from the first portion and a restraining position adjacent the first portion.

Turning to FIG. 3, the first portion 18 of the restraint assembly is illustrated as including a pair of horizontally extending mounting bars 34 formed of tubular material and welded to the tubular members 20 at a 45° angle to both the tubular members 20 and the members 24 of the front wall. The second portion 32 of the restraint assembly also includes a pair of horizontally extending mounting bars 34 welded to the tubular members 26 at a 45° angle thereto.

Each of the mounting bars 34 of the restraint assembly includes a plurality of transverse holes 36 extending through the bar in a horizontal direction. A restraining bar 38 is supported between each pair of vertically spaced mounting bars 34 and includes means for securing the restraining bar to each of the mounting bars to hold the restraining bar in a desired position.

Figure 4:
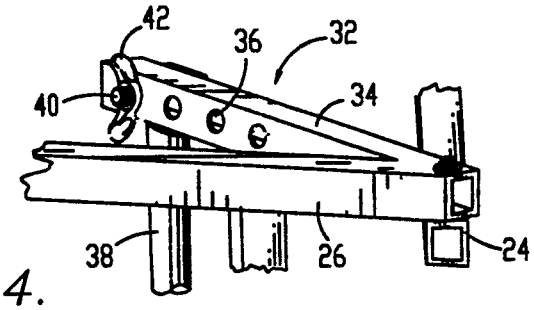
FIG. 4 is a fragmentary perspective view of a portion of the restraint assembly which is mounted on the second side panel of the apparatus.

As shown in FIG. 4, a bolt 40 and wing nut 42 are provided at each end of each restraining bar 38, and are adapted to be received in any of the transverse holes 36 so that each restraining bar may be secured between the associated mounting bars 34 at any of a number of different positions along the axial lengths of the bars.

By providing this construction of the neck restraint assembly, is possible to adjust the distance between the restraining bars so that the apparatus may be modified to accommodate calves varying in size from newborn to up to about 200 lbs.

Locking means are provided on the apparatus for holding the side panel 12 in the closed position relative to the frame 10 and preventing movement of the side panel toward the open position. As shown in FIG. 1, the locking means includes a chain 44 which is secured to the frame, and a hook 46 provided on the panel 12. During use, once a calf has been positioned within the chute, and the panel 12 has been moved to the closed position, the chain 44 is lifted over the panel 12 and secured on the hook 46. Release of the animal simply requires the chain to be lifted from the hook so that the panel may be moved back to the open position.

Numerous advantages are achieved through the use of the preferred construction. For example, by uniting a movable side panel with a portion of the neck restraint assembly, it is possible for a handler to load a small calf into the chute and to close the chute onto the calf without assistance, and the head of the calf will be positively restrained at the same time that the calf is closed into the chute. Thereafter, the chute may be locked, and any desired treatment, such as banding, tagging, implantation of hormones or the like may be carried out.

Alternately, by securing the chute apparatus within a vehicle, such as in the back end of the pickup, it may be used to transport a calf from one location to another while protecting the calf against injury.

Although the invention has been described with reference to the preferred embodiment illustrated in the attached drawing figures, it is noted that substitutions may be made and equivalents employed herein without departing from the scope of the invention as recited in the claims.

What is claimed is:

1. A calf chute apparatus comprising:

a frame including a first side panel;

a second side panel having a forward end connected for pivotal movement relative to the frame about a vertical axis so that the second side panel is movable between open and closed positions; and a neck restraining means for restraining the neck of a calf positioned in the apparatus when the second side panel is in the closed position, the restraining means including a first neck restraint fixed relative to the frame and a second neck restraint fixed relative to the second side panel, the second neck restraint and second side panel being movable together relative to the frame so that when the second side panel is moved between the open and closed positions, the second neck restraint moves between a releasing and a restraining position relative to the first neck restraint.

2. A calf chute apparatus as recited in claim 1, wherein the frame includes a front wall extending between the first and second side panels, the second side panel being supported for pivotal movement on the front wall.

3. A calf chute apparatus as recited in claim 1, wherein the first and second neck restraints each include a pair of spaced, elongated horizontal mounting arms, and a vertical restraining bar extending between the mounting arms.

4. A calf chute apparatus as recited in claim 3, wherein the position of each restraining bar along the lengths of the mounting arms between which the restraining arm extends is adjustable.

5. A calf chute apparatus as recited in claim 1, further comprising locking means for holding the second side panel in the closed position relative to the frame and preventing movement of the second side panel toward the open position.

* * * * *